United States Patent [19]

Hemingway

[11] Patent Number: 4,577,899

[45] Date of Patent: Mar. 25, 1986

[54] LINER CUP REMOVER

[75] Inventor: James K. Hemingway, Berkhamsted, England

[73] Assignee: H. Pattison & Company Ltd., Middlesex, England

[21] Appl. No.: 638,692

[22] Filed: Aug. 8, 1984

[30] Foreign Application Priority Data

Sep. 9, 1983 [GB] United Kingdom ..... 8324183

[51] Int. Cl.[4] ..... B66C 1/00

[52] U.S. Cl. ..... 294/95; 294/97; 29/280

[58] Field of Search ..... 29/280, 272; 294/97, 294/95, 86.25, 86.24

[56] References Cited

U.S. PATENT DOCUMENTS

| | | | |
|---|---|---|---|
| 1,445,581 | 2/1923 | Fullop | 294/86.24 |
| 3,057,651 | 10/1962 | Lloyd | 294/97 |
| 3,519,304 | 7/1970 | Shores | 294/97 |
| 4,377,956 | 3/1983 | Cooper | 294/95 |

FOREIGN PATENT DOCUMENTS

| | | | |
|---|---|---|---|
| 685790 | 1/1953 | United Kingdom | 294/95 |
| 438781 | 1/1975 | U.S.S.R. | 294/97 |
| 839992 | 7/1981 | U.S.S.R. | 294/95 |

*Primary Examiner*—Robert C. Watson

*Attorney, Agent, or Firm*—Saidman, Sterne, Kessler & Goldstein

[57] ABSTRACT

A liner cup 2 can be removed from a golf hole 1 by a tool with a shaft 6 and wedge-shaped member 9 pivoted on arms 8 extending from the shaft so that they fold inwards as the shaft is positioned in the cup (by placing nose 6*d* into the conventional bottom recess) and fold outwards to grip by their curved outer edges 9*a* at the inner liner cup surface as the shaft is pulled up, thereby removing the cup 2 from the ground by frictional engagement of the edges 9*a*. In case simple frictional engagement is inadequate, e.g. in wet weather, a sleeve 12 is mounted to be slid upwards by arm 13 when second handle 14, pivoted at 15 to the shaft is manipulated so that limb 14*a* lies nearest handle 7, or conversely downwards when 14 is oppositely pivoted. These movements respectively release from and urge on to the members 9, the rim of saucer shaped pressure exerting means 11, allowing in one mode easy entry (as before) of the tool into the cup but giving in the other mode a positive immobilizing pressure on members 9 as the tool is lifted.

10 Claims, 8 Drawing Figures

LINER CUP REMOVER

This invention relates to equipment for use on golf courses, and more particularly to equipment for removing the lining cup from a golf hole.

A golf hole has a nominal 4¼-inch (110 mm) diameter, and is formed by cutting a cylindrical 4¼-inch (110 mm) hole in the turf of the green and placing within the hole a metal or moulded polymer liner cup or cylinder. The position of the hole on the green is changed frequently (daily in some instances) to avoid wear on the turf and to vary the game. In order to change the position of the hole it is necessary to extract the liner and to position the liner in a new hole cut by a suitable tool. Typically, the turf plug removed from the new hole then goes to fill the previous hole. Also, from time to time, the green is spiked or slit to aerate the turf. When this is done the liner is removed so that the machine used for slitting or spiking the turf does not damage the upper edges of the liner.

Liner cups have two holes located towards the upper edge, at opposite ends of a diameter, and extending through the wall. In order to remove such liners the greenkeeper has to kneel close to the hole, carefully insert a device comprising two hooks (one for each hole) and then pull out of the hole the device and the attached liner. This has the disadvantage that it takes a little time to locate and engage the holes, and that the hooks, which extend completely through the holes, can damage the sides of the earth surface within which the liner is located. Moreover, since the liner is a thin-walled device, it tends to become distorted after a period of use, probably because the pulling force located at two points at opposite ends of a diameter, tends to pull the walls inwards as well as pull the liner upwards.

The present invention sets out to overcome this disadvantage by providing a tool which can be simply plunged into the liner cup by a greenkeeper standing normally above the hole, and thereafter pulled up with the cup attached to it. The tool, according to the invention, does not require specific location points in relation to the liner, and in its preferred form provides quicker, easier and effective lifting without the risk of damage either to the earthen hole or to the liner itself.

In one aspect the invention consists in a tool for removing the liner from a golf hole, comprising an elongate shaft with lateral projections extending from a position at or near one end and pivoted for movement from an inner position close to the shaft to an outer position at which the outer edges of the projections may contact the inner surface of a surrounding golf hole liner; whereby, as the shaft is introduced into the liner the projections pivot towards the shaft, and as the shaft is subsequently pulled outwardly the projections pivot away from the shaft to engage the liner inner surface by friction and thereby remove the liner cup from the hole.

There should be at least two such projections. In practice, three or preferably four projections, in the latter case arranged in a cruciform configuration, are preferred.

The projections themselves may be pivoted upon arms extending laterally from the shaft. They are most preferably wedge-shaped, so that they contact the cup with a line contact edge on each projection; to improve this contact these edges can be radiussed at the same curvature as the inner wall of the liner.

In practice, we have found that metal wedges provide adequate friction.

The upper end of the shaft will preferably be provided with a T-shaped, or other, handle for easy removal of the cup.

Optionally, a sleeve may be slidable on the shaft and carry pressure-exerting means, being selectively movable from a first, remote, position whereby the lateral projections can pivot freely and second, engaged, position where the pressure-exerting means contacts and immobilises each lateral projection so that these are positively held with their outer edges in frictional engagement with the liner cup.

This selective movement can be achieved by having an elongate arm extending along the shaft attached at one end to the sleeve and attached pivotally at the other to one limb of a handle itself centrally pivoted to the shaft. Movement of this pivoted handle in opposite directions moves the sleeve according to hold or release the lateral projections.

This selective movement can alternatively be achieved by using a hollow shaft with an internal longitudinal rod (a) protruding from the top centrally of the handle and (b) connected by transverse pins, through slots in the shaft wall, to the sleeve. The slots define the range of sleeve movement. Thumb pressure on the end of the rod pushes down the sleeve to ensure good grip at the edges of the lateral projections.

The invention will be further described with reference to the accompanying drawings, in which.

Figure 1:
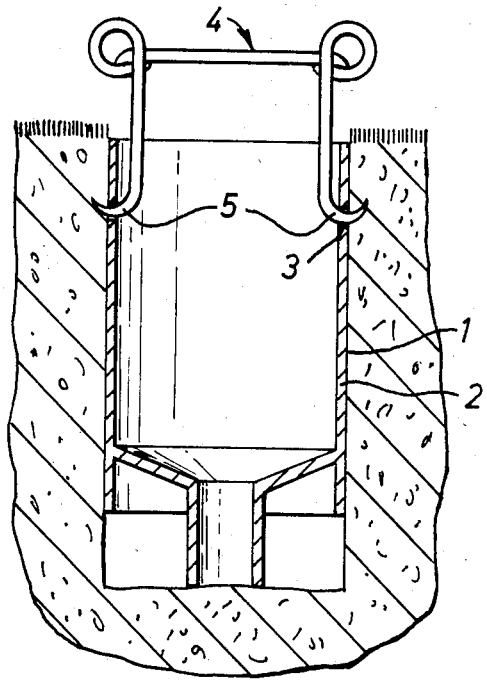
FIG. 1. PRIOR ART
FIG. 1 shows a prior art expedient for the removal of a liner cup from a golf hole.

In FIG. 1 a hole of 4¼-inches diameter has earth walls 1 and is lined by a liner cup 2 of a standard configuration with a shaped base as shown. This standard configuration includes holes 3, at opposite ends of a diameter, located towards the upper edge of the liner cup. To remove such a liner cup a tool such as generally shown at 4 is used. Its use involves the greenkeeper kneeling close to the hole, inserting hooks 5 (one in each hole 3), and thereafter pulling out the liner. Since the hooks have to go all the way through the holes and project they can damage the ground at a crucial location towards the top of the hole. The use of this prior art device is therefore slow and needs a modicum of care if it is not to be detrimental to the green.

Figure 3:
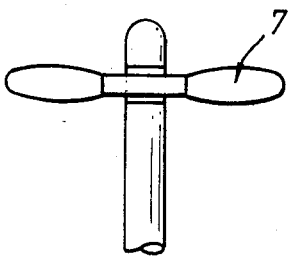
FIG. 3 shows a section of the device along lines III—III in FIG. 2.
Figure 3:
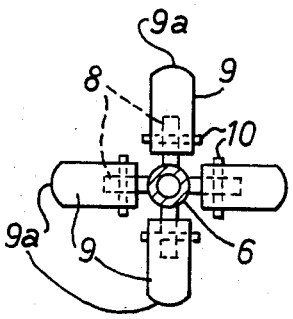
Figure 2:
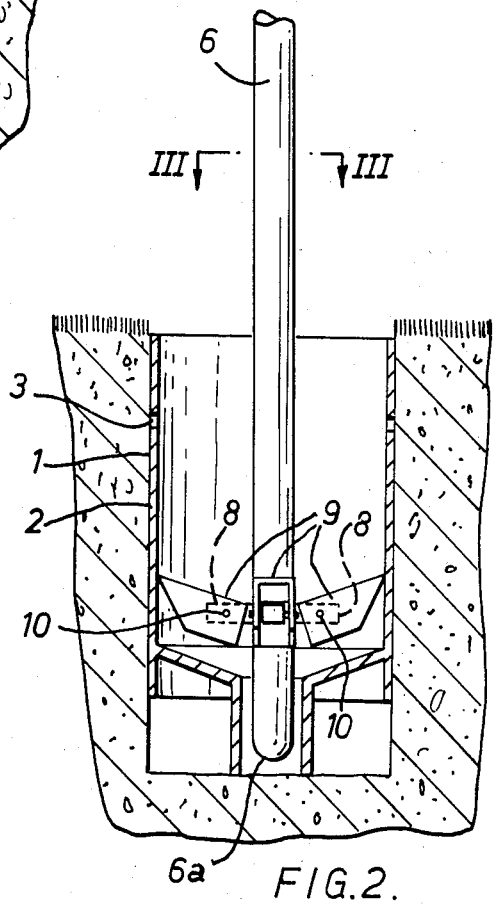
FIG. 2 shows in longitudinal view a device according to the invention located within a lined golf hole, immediately prior to removal of the liner from the hole.

The shape shown in FIG. 2 comprises an elongate shaft 6, an uppermost T-shaped handle 7, and, towards the bottom end of the shaft, four extending arms 8, to each of which is pivoted a wedge-shaped member 9 by means of transverse cylindrical pins 10 (see also FIG. 3). The dimensions of each wedge-shaped member 9 are in each case such that the members can fold back against the shaft or can fold outwards away from the shaft. If, as shown, they are located within the cup they cannot fold out to such an extent that they are fully extended or "over-centre".

In use, the tool is pushed down inside the lined hole by a greenkeeper in a standing position. The end nose 6*a* enters the conventional lower extremity of the golf hole. The pivoted wedges 9 initially pivot outwards to the extent shown, but slide down easily within the hole to the position shown in FIG. 2. The device is then pulled up by means of handle and the extenal edges 9*a* of the wedges 9 which are radiussed to contact the cylindrical liner surface in a liner cup grip by friction. Thus, the liner is removed from its surrounding earth hole.

The removed liner can be readily separated from the device merely by inverting the combination; if this is done the wedge member falls back against the shaft (especially on slight agitation of the shaft in relation to the liner) and the liner can be lifted off upwards for re-use.

It will be appreciated that, in use, the harder it is to remove the liner from a given hole, the better the grip given by the edges 9*a* of the wedges 9. Moreover, there is no damage to the cup as it is gripped internally at four spaced lines of contact, and these are moreover located well into the cup and towards the rigidifying lowermost base structure as shown. Also, since there are no hooks which necessarily protrude from the liner, there is no damage to the surrounding earth walls of the hole.

Figure 4:
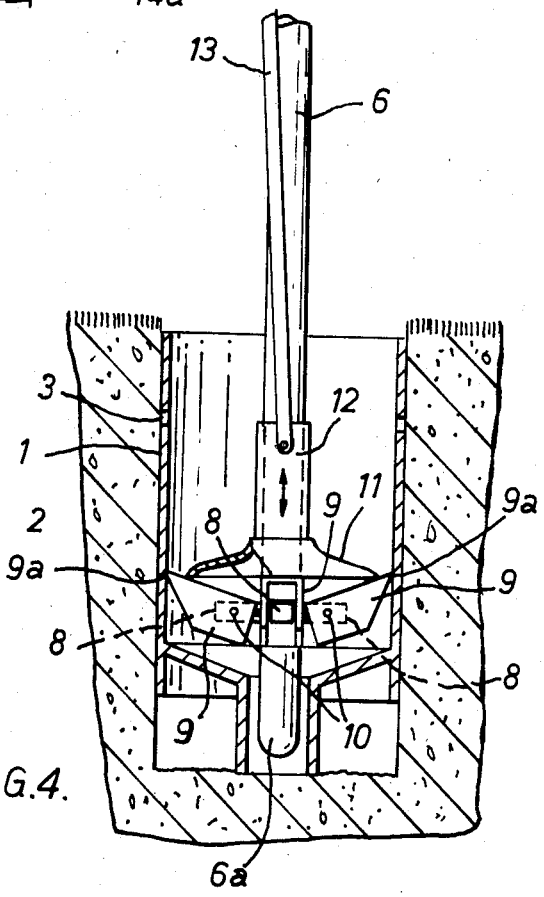
FIG. 4 shows in the same view as FIG. 2 a modification of the device which improves the grip upon the interior of the liner.

If there should be difficulty in removing liner cups, e.g. in wet weather, the embodiment of FIG. 4 can be adopted.

FIG. 4 shows a device as in FIG. 2 with a corresponding features similarly referenced. To give positive assistance to the wedges when they grip the interior surface of the liner, especially useful if the cups are made of polymer and if the weather is wet, there may be incorporated a selectively operable pressure-exerting means comprising an inverted saucer-shaped member 11, with its rim radially outside pivot-points 10, surrounding a sleeve 12 slidable on shaft 6 above the wedges; an elongate arm 13 extending generally along shaft 6, pivoted to sleeve 12 and rigid enough to act as a strut as well as a tie; and an operating handle 14 centrally pivoted at 15 to the shaft 6 and further pivoted at 16, near pivot 15, to an upper end of arm 13. Handle 14 has two handle arms 14*a* and 14*b*, one to either side of pivot 15. They are not aligned, but lie at an angle to one another, so that pivoting about 15 brings either handle arm 14*a* close to and generally parallel with the handle portion 7*a* of handle 7 or conversely handle arm 14*b* close to and generally parallel with handle portion 7*b*.

This improved version operates as follows.

To insert the lower end of the tool into the lined hole, handle portion 7*a* and handle arm 14*a* are jointly grasped by the operator, so that handle portion 7*b* is separated from handle arm 14. Arm 13 pulls sleeve 12 up shaft 6, withdrawing saucer 11 from contact with the wedges 9 and thus allowing them to pivot upwards, as described above, and the tool enters the hole.

To withdraw the tool and liner from the earth hole, handle portion 7*b* and handle arm 14*b* are jointly gripped, but handle portion 7*a* is gripped alone i.e. releasing handle arm 14*a*. This forces the sleeve 12 downwardly by arm 13 and the rim of the saucer 11 presses the wedges 9 to pivot downwards thus assisting their frictional engagement with the walls of the liner 2 and permitting even wet nylon liners to be readily removed.

To separate the tool from the withdrawn liner, handle portion 7*a* and handle arm 14 are again jointly gripped thereby allowing the wedges to disengage e.g. upon inversion.

Figure 5:
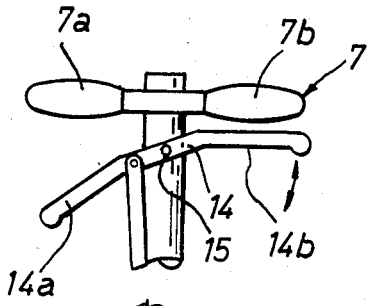
FIG. 5 shows in perspective a view on a larger scale of a typical wedge member pivotally mounted on a radial arm.
Figure 5:
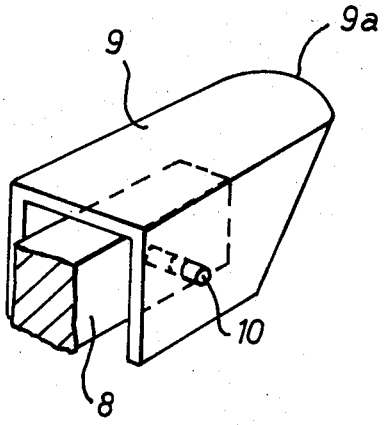

FIG. 5 shows in perspective view one wedge-shaped member 9 pivoted on pins 11 on an arm 8. The wedge 9 is generally channel-shaped. The inner surface of its upper part is spaced from the top of the arm 8, so as to allow suitable pivoting (see below). The outermost edge 9*a* is radiussed suitably to contact the inner liner cup surface over a curved line contact.

Figure 6:
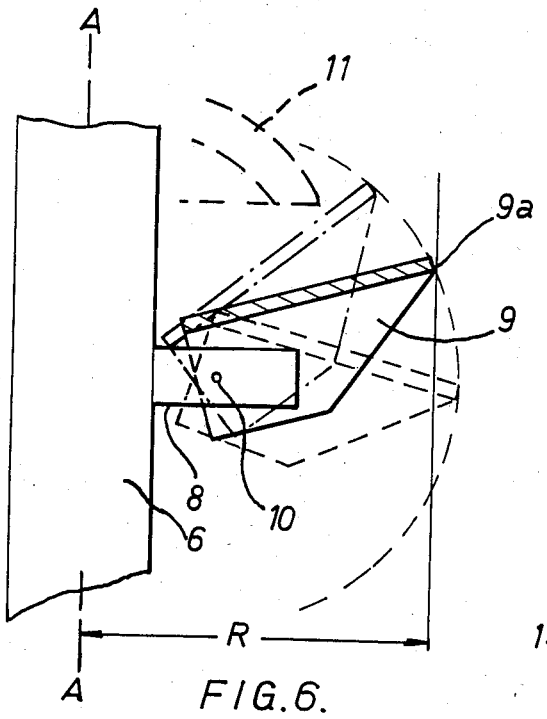
FIG. 6 shows diagrammatically certain design criteria for the device.

FIG. 6 shows diagrammatically certain design constraints which should preferably be observed for easy use of the equipment.

If shaft 6 is placed axially in the liner cup 2 it is desired that wedges 9 adopt a position somewhat as shown in full lines. Edge 9*a* touches the cup at a level above arm 8, and the wedge 9 is inclined as shown. In this position the wedge 9 rear inner top edge has still not contacted the arm 8, and this clearance allows for inaccuracies in initial placement of the tool in the liner cup.

After the cup has been drawn out the tool is inverted. The wedges take up their extreme position as shown in chain dotted lines, i.e. with the rear inner edge of wedge 9 resting on the arm 8. (In practice, it is also possible to design the construction so that in this extreme position the rear outer top edge rests against the shaft 6, or so that wedge top surface encounters the edge of the retracted saucer 11 if used).

When the tool is separated from the cup and again placed in its normal orientation for use, the wedges 9 fall in the other direction, as shown in dashed lines. In this position, the inner top surface of the wedge rests on the extreme point of arm 8, and the edges 9*a* extend to a distance beyond the cup internal radius R, to permit ready re-use of the tool.

Figure 7:
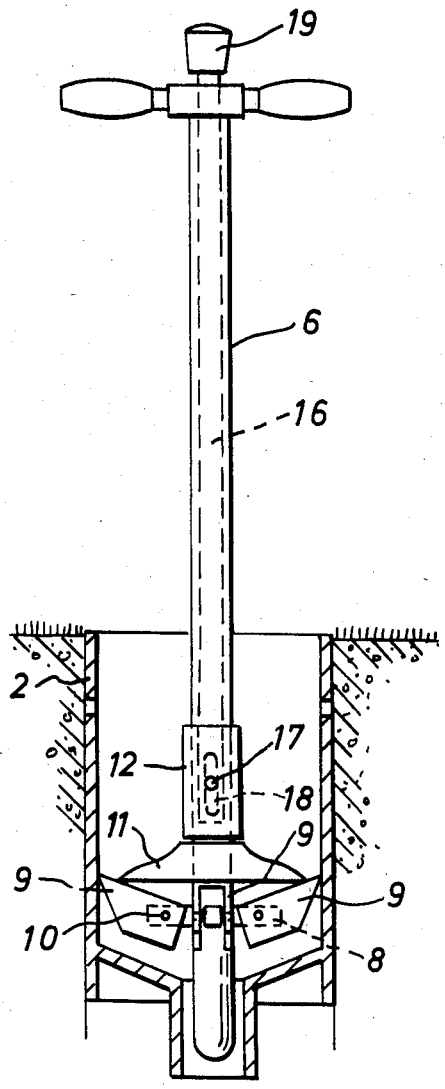
FIG. 7 shows in the same view as FIGS. 2 and 4 a yet further modification of the device.
Figure 8:
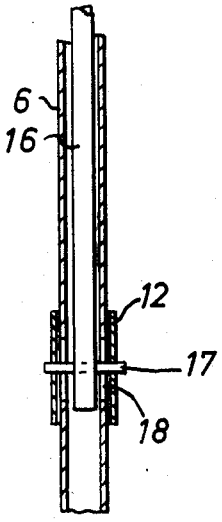
FIG. 8 shows a fragmentary section of part of FIG. 7.

FIG. 7 shows a tool which performs the same task as that of FIG. 4 (namely, improved grip) without the angled linkage. Reference numerals are generally equivalent. Instead of arms 13 and 14, and pivot 15, a rod 16 extends down shaft 6 which is in this case made hollow for this purpose. At its bottom end the shape posseses a fized transverse pin 17 extending at each end through radially aligned longitudinal slots 18, in the walls of hollow shaft 6, for attachment to sleeve 12. The upper end of rod 16 protrudes centrally above handle 7 and is provided with a polymer cap 19.

When the tool is inserted the sleeve 12 is pushed by wedges 9 and causes pins 17 to ride up their slots 18 and the top cap 19 of the shaft to protrude upwards. To remove the liner cup, thumb pressure on cap 19 exerts sufficient positive immobilizing pressure on wedges 9, as with FIG. 4.

I claim:

1. A tool for removing the liner cup from a golf hole comprising:

a straight elongate shaft;

a sleeve slidable longitudinally on said shaft;

at least two like members extending generally radially outwards from near one end of the said shaft;

a pivot axis for each member located in each case at right angles to the shaft and at right angles to the general radial orientation of the said member;

an outer edge on each said member, capable of frictional engagement with an inner surface of said liner cup;

the said members being freely pivotable about their respective pivot axes between (a) positions in which their outer edges are located at distances greater than the standard radius of a golf hole from the elongate shaft longitudinal axis and (b) positions in which their outer edges are located at distances less than the said standard radius from the said longitudinal axis;

a handle at the end of said shaft remote from the generally radial members, said handle extending transversely to each side of the shaft;

laterally extending pressure exerting means attached to one end of said sleeve; and means permitting selective positioning of said sleeve in relation to said shaft between a first position remote from the radially extending pivotable members, whereby said members can pivot freely towards the shaft and a second position with the pressure exerting means contacting and immobilizing said radially extending pivotable members, whereby they are positively held with their outer edges frictionally engaging the inner surface of the liner cup; said means permitting selective positioning of said sleeve comprising:

a elongate hollow extending from the top of the said shaft at least to the sleeve, said shaft being formed with radially aligned longitudinal slots in the walls beneath said sleeve;

a rod extending movably along said hollow shaft;

transverse pins extending diametrically from said rod to protrude through each said slot for attachment to said sleeve, whereby said sleeve is capable of movement to an extent defined by abutment of said pins with the ends of said slots;

said rod protruding longitudinally from the upper end of said shaft centrally of said handle;

whereby thumb pressure can be exerted on the protruding end of said rod, as the handle is pulled, to force the sleeve downwardly and bring the pressure-exerting means into immobilizing contact with the pivoted members.

2. A tool as claimed in claim 1 in which the said laterally-extending pressure-exerting means is a downwardly concave saucer-shaped member attached to the lower end of the sleeve and extending around the shaft, for selective contact at its rim with the said generally radial pivotal members as the sleeve is moved.

3. A tool as claimed in claim 1, having four of the generally radial pivotal members arranged in a cruciform configuration.

4. A tool for removing the liner cup from a golf hole comprising:

a straight elongate shaft;

four support arms extending from the shaft in a cruciform configuration;

four like members each extending generally radially outwards from one of said support arms; a pivot axis for each member located in each case at right angles to the shaft and at right angles to the general radial orientation of the said member;

an outer edge on each said member, capable of frictional engagement with an inner surface of said liner cup; the said members being freely pivotable about their respective pivot axes between (a) positions in which their outer edges are located at distances greater than the standard radius of a golf hole from the elongate shaft longitudinal axis and (b) positions in which their outer edges are located at distances less than the said standard radius from the said longitudinal axis;

and in which each generally radial pivoted members (i) is channel-shaped to fit over one of said support arm and be pivoted thereto (ii) tapers as a wedge towards its outer edge and (iii) is shaped as the arc of a circle at its outer edge to conform with the liner cup interal surface.

5. A tool as claimed in claim 4 further comprising:

a sleeve slidable longitudinally on the shaft;

laterally-extending pressure-exerting means attached to one end of said sleeve; and means permitting selective positioning of said sleeve in relation to said shaft, between a first position remote from the radially extending pivotable members, whereby said members can pivot freely towards the shaft and a second position with the pressure-exerting means contacting and immobilising said radially extending pivotable members, whereby they are positively held with their outer edges frictionally engaging the inner surface of the liner cup.

6. A tool as claimed in claim 5 further comprising a first handle at the end of said shaft remote from the generally radial members, said handle extending transversely to each side of the shaft;

and in which said means permitting selective positioning of said sleeve comprises:

an elongate arm extending generally along the shaft, attached at one end to the sleeve; and a second transverse handle extending to each side of the shaft from a generally central pivot, said second handle being spaced from said first handle, and said elongate arm being further pivoted at its other end to one limb of the second handle;

whereby selective pivotal movement of the said second handle so that the said limb moves towards the first handle moves the sleeve along the shaft to its said first position, and selective pivotal movement of the said second handle so that the said limb moves away from the first handle moves the sleeve along the shaft to its said second position.

7. A tool as claimed in claim 4, in which the end of the shaft extends beyond the generally radial pivotal members for easy location in the central recess of a liner cup.

8. A tool for removing the liner cup from a golf hole comprising:

a first straight elongate tubular shaft;

a sleeve slidable longitudinally on said first shaft;

at least two members mounted for pivoting to extend generally radially outwardly from near one end of said first shaft;

each of said member having an outer edge for frictional engagement with an inner surface of said liner cup;

each said members being pivotable between positions in which their outer edges are located at distances greater than the standard radius of a golf hole from the longitudinal axis of the elongate shaft and positions in which their outer edges are located at distances less than said standard radius from the longitudinal axis;

a handle at the end of said first shaft remote from said members, said handle extending transversely to each side of the first shaft;

means for exerting pressure on said members operatively connected to said sleeve;

said sleeve sliding on said first shaft, between a first position in which said means for exerting pressure is remote from the radially extending pivotable members, whereby said members can pivot freely towards the first shaft, and a second position in which said means for exerting pressure contacts said radially extending pivotable members, such that the outer edges of the members are urged into frictional engagement with the inner surface of the liner cup; and means for controlling the position of said sleeve, said means for controlling the position of said sleeve comprising:

a second shaft extending from the top of the first shaft at least to the sleeve, for moving within tubular first shaft shaft;

transverse pins extending diametrically outwardly from said second shaft and protruding through corresponding longitudinal slots in said first shaft, and into holes in said sleeve, whereby said sleeve is capable of movement to an extent defined by abutment of said pins with the ends of said slots;

said second shaft protruding longitudinally from the upper end of said first shaft centrally of said handle;

whereby pressure can be exerted on the protruding end of said rod, to force the sleeve downwardly, and bring the means for exerting pressure into contact with the pivoted members.

9. The tool of claim 8 wherein said means for exerting pressure on said members comprises a downwardly concave saucer-shaped member attached to the lower end of the sleeve for contacting said pivoted members as the sleeve is moved.

10. A tool for removing the liner cup from a golf hole comprising:

a straight elongate shaft;

four support arms extending from the shaft in a cruciform configuration;

four like members each extending generally radially outwards from one of said support arms, and mounted for pivoting thereon about axes perpendicular to the axis of said shaft;

each said member having an outer edge for frictional engagement with the inner surface of said liner cup, said members being freely pivotable about their respective pivot axes between positions in which their outer edges are located at distances greater than the standard radius of a golf hole from the axis of the shaft and positions in which their outer edges are located at distances less than said standard radius from said axis;

each of said pivoted members being channel-shaped to fit over the corresponding support arm, having a wedge shape, tapering towards its outer edge and having its outer edge shaped in the arc of a circle, to conform with the internal surface of the liner cup.

* * * * *